United States Patent [19]

Brandberg et al.

[11] Patent Number: 4,970,358

[45] Date of Patent: Nov. 13, 1990

[54] MICROWAVE SUSCEPTOR WITH ATTENUATOR FOR HEAT CONTROL

[75] Inventors: Lawrence C. Brandberg, Minneapolis; Denise E. Hanson, Elk River; Jeffrey T. Watkins, St. Paul, all of Minn.

[73] Assignee: Golden Valley Microwave Foods Inc., Edina, Minn.

[21] Appl. No.: 456,159

[22] Filed: Dec. 22, 1989

[51] Int. Cl.[5] ..... H05B 6/64

[52] U.S. Cl. ..... 219/10.55 F; 219/10.55 E; 426/107; 426/234; 426/243; 99/DIG. 14

[58] Field of Search ..... 219/10.55 F, 10.55 E, 219/10.55 D, 10.55 R, 10.55 M; 426/107, 241, 243, 234; 99/DIG. 14; 126/390; 174/35 R, 35 MS

[56] References Cited

U.S. PATENT DOCUMENTS

| | | | |
|---|---|---|---|
| 4,190,757 | 2/1980 | Turpin | 219/10.55 E |
| 4,264,668 | 4/1981 | Balla | 428/195 |
| 4,283,427 | 8/1981 | Winters | 426/107 |
| 4,518,651 | 5/1985 | Wolfe | 428/308.8 |
| 4,713,510 | 12/1987 | Quick et al. | 219/10.55 E |
| 4,806,718 | 2/1989 | Seaborne | 219/10.55 E |
| 4,808,780 | 2/1989 | Seaborne | 219/10.55 E |
| 4,810,845 | 3/1989 | Seaborne | 219/10.55 E |
| 4,818,831 | 4/1989 | Seaborne | 219/10.55 E |
| 4,864,089 | 9/1989 | Tighe et al. | 219/10.55 E |
| 4,904,836 | 2/1990 | Turpin et al. | 219/10.55 E |

FOREIGN PATENT DOCUMENTS 0276654 8/1988 European Pat. Off. .

*Primary Examiner*—Philip H. Leung
*Attorney, Agent, or Firm*—James V. Harmon

[57] ABSTRACT

A thermocompensating susceptor is described comprising a microwave transparent sheet, e.g. paper, paperboard or plastic, having a layer thereon of a dried dispersion comprising a film forming vehicle together with two kinds of dispersed particles including microwave intractive particles such as a metal, metal oxide, carbon or graphite that absorbs microwave energy to produce heat in a microwave oven and electrically nonconductive thermocompensating particles of a mineral hydrate containing bound water of crystallization and having a dissociation temperature between about 100° F. and 500° F., at which temperature the bound water is released therefrom to prevent overheating of the laminate.

16 Claims, 7 Drawing Sheets

MICROWAVE SUSCEPTOR WITH ATTENUATOR FOR HEAT CONTROL

FIELD OF THE INVENTION

The invention relates to a susceptor adapted to produce heat when exposed to microwaves.

BACKGROUND OF THE INVENTION

In the prior art, a variety of substances including metal particles, ferrites, carbon or graphite particles, oxides of the metals zinc, germanium, barium, tin, iron and the like have been incorporated into coatings for producing heat in a microwave oven, i.e. to act as a heating susceptor for the purpose of absorbing a portion of the microwave energy and converting it to heat. Various other chemical susceptors such as salts are employed in an aqueous solution for this purpose as described in U.S. Pat. No. 4,283,427. A quantity of free water must be provided to dissolve the salt so that it is in an ionic form that will interact with the microwave energy to produce heat. This requires that the wet product be placed in a pouch that is sealed at its edges. This wet product has many disadvantages including its bulk, fluidity and the complexity of the manufacturing operation. U.S. Pat. Nos. 4,264,668 and 4,518,651 describe coatings containing carbon black. However, it has been found that carbon-containing heat producing coatings, when heated in a microwave oven, can be subject to a runaway heating condition that often produces arcing, sparking, burning or charring of the backing sheet to which they are applied. U.S. Pat. Nos. 4,806,718; 4,808,780; 4,810,845 and 4,818,831 describe ceramic devices for microwave heating, primarily green ceramics, which employ a quantity of bound water to produce heating. The ceramic gel itself produces heat.

In developing the present invention it was found that when carbon was used alone with a film former, such as a standard ink base, that burning and uncontrolled temperature rise occurs. Many of the packages burst into flames when heated in a microwave oven. It was also found that when carbon was mixed with an aqueous acrylic dispersion, the resulting susceptor would burn the package. A rapid, uncontrolled temperature rise occurs. Discoloration appears at about 400° F. Then ignition follows almost immediately. The package starts to brown at about 400° F. and then quickly begins to burn which is, of course, unacceptable. Once the package begins to carbonize, this facilitates further heating and accelerates the burning reaction which causes burning to occur at an even faster rate. This can be referred to as runaway heating.

An important objective of the invention is to provide a microwave susceptor layer that can be applied at little or no pressure as a fluid and which, upon exposure to microwave heating, will produce a uniform heat without unacceptable arcing, popping, sparking or burning. It is another objective to obtain uniformity of heating in different portions of the package and also from one sample to another. The susceptor composition should have characteristics that allow it to be applied as a fluid by a variety of methods including roll printing, silk screen printing, spraying, dipping, brushing and the like. The composition should preferably be useful with gravure printing, one application method found to allow especially good coating weight control. The fluid susceptor, sometimes referred to herein for convenience as "ink," should be capable of being applied directly onto a backing such as paper, paperboard or the like without the requirement for multiple superimposed coatings, plastic sheets or high pressure which increase production costs and capital requirements.

When applied by printing, the fluid susceptor composition should have all the qualities of a good printing ink including the proper rheological properties: viscosity, dilatency and thixotropy to avoid problems such as misting, splattering or dripping from freshly printed surfaces moving at high speed and must also transfer easily from the supply roll to the printing roll. The susceptor fluids or inks of the present invention should also produce coatings of uniform thicknesses and be able to form both a continuous and interrupted coating, e.g. a coating with a multiplicity of openings or uncoated spots within a coated area.

It is a further object of the invention to control or stabilize the heat produced by a microwave interactive material by providing a cooling effect at a selected temperature or at a plurality of temperatures within a selected temperature range to compensate for the heat produced by the microwave interactive material.

A more specific object is to control heating of a susceptor so that it can be used on paper without the paper charring or catching on fire.

When printing is the application method, another object is to enable printing of the susceptor to be accomplished using standard printing equipment at normal speeds, up to 1200 feet per minute. A further object is to provide a susceptor for heating foods which is food safe.

Yet another object is to match or exceed the performance of commercially available microwave susceptors that employ vapor deposited semiconductive aluminum coatings.

When overheating occurs at the periphery or along the edge of a susceptor, it is an object to reduce or eliminate overheating, charring or burning of this kind along the edge of a printed susceptor.

These and other more detailed and specific objects of the invention will be apparent in view of the accompanying drawings and specification which set forth by way of example but a few of the various forms of the invention that will be apparent to those skilled in the art once the principles described herein are understood.

SUMMARY OF THE INVENTION

The invention provides a thermocompensating susceptor. The susceptor preferably includes a microwave transparent backing sheet formed from a microwave transparent substance such as plastic resin, paper or paperboard that is stable during heating up to at least about 400° F. and a microwave susceptor layer applied to the backing. The susceptor layer comprises a dried dispersion composed of an apparently homogeneous microscopically heterogeneous mixture of at least two phases composed of particles and a liquid dispersant. The dispersion includes organic film forming resin particles or binders dispersed in a liquid dispersant and, most preferably, two other kinds of dispersed particles. One kind of particle comprises a microwave interactive particle selected to absorb microwave energy and produce heat. The other particle comprises electrically nonconductive thermocompensating particles of a mineral hydrate containing bound water of crystallization and having a dissociation temperature in the range of between about 100° F. to 600° F. and preferably between about 250° F. to 450° F. The mineral hydrate attenuator functions to limit and control runaway heating of the susceptor during heating in a microwave oven. This is due to a cooling effect produced by the hydrate. Prior to heating, water molecules are tightly bound in the compound. When heated, the attenuator retains water molecules until the initial dissociation temperature is reached and then begins to give them off. It appears to be the release of the water molecules which produces a cooling effect, thereby stabilizing the temperature of the packaging material until all of the water molecules have been released. However, because the water molecules are tightly bound in the hydrate, the coating can be considered dry to the touch and can be used to form a stable coating that can be exposed, e.g. on the outside of a package, if desired and preferably does not rub off easily.

The susceptor layer can be applied by a variety of methods including printing, dipping, spraying, brushing and the like.

THE FIGURES

FIG. 1. is a perspective view showing sheet material to which a susceptor fluid is applied in accordance with one form of the invention;

DETAILED DESCRIPTION OF THE INVENTION

Figure 1:
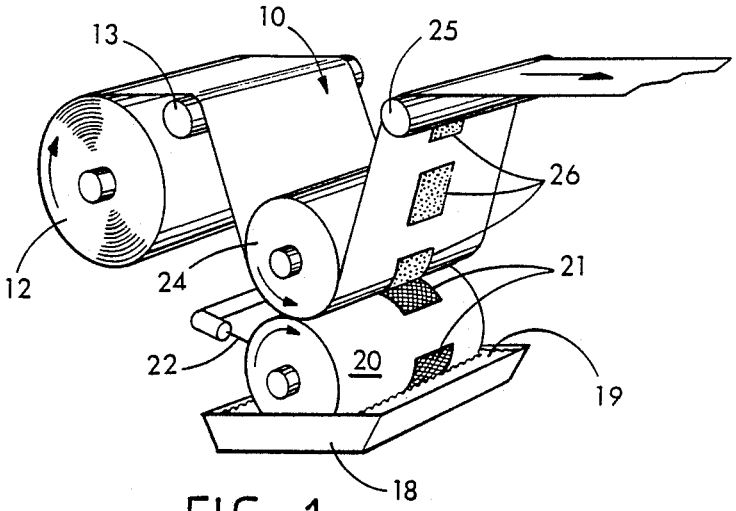

The present invention provides a backing sheet composed of a microwave transparent sheet material such as paper, paperboard or plastic that is transparent to microwave energy that has a susceptor layer or coating thereon. The susceptor coating comprises a dispersion composed of a fluid vehicle or binder in which most preferably is uniformly suspended two kinds of dispersed particles. One kind is an electrically conductive microwave interactive particle which produces heat in a microwave field. The other is an electrically nonconductive non-microwave interactive mineral attenuator hydrate in particulate form for dissipating, spreading and/or modulating the energy absorbed and converted to heat by the conductive particles. Thus the dispersed phase comprises two kinds of uniformly intermixed suspended particles of different compositions. Only the conductive particles interact with microwave energy directly to produce heat. Both suspended materials are composed of microscopic size particles that remain dispersed or in suspension in the vehicle until used. During heating the suspended attenuator particles prevent localized energy buildup and runaway heating that would otherwise occur.

In accordance with the present invention the backing consists of a sheet of paper, paperboard, plastic film or other flexible microwave transparent organic polymeric sheet material. The backing sheet material can, for example, be 15 to 50-pound greaseproof kraft paper or paperboard such as 18 or 20 point paperboard, plastic film such as polyester, nylon, cellophane or the like. The susceptor coating applied to this backing sheet forms a bilayer. The fluid vehicle or film former serves as a binder or matrix to hold the coating together and to the backing. The vehicle of the susceptor can comprise any suitable vehicle or binder such as an acrylic or maleic resin, e.g. maleic rosin ester, polyvinyl acetate, protein or soluble shellac. The best printability and drying is provided by acrylic resins. The shelf life and dispersion ability are also better with acrylic resins and, accordingly, an acrylic resin vehicle is preferred but is not essential. Thus, as the dispersion or "ink" dries, the acrylic particles present in the emulsion coagulate or flow together to form a film. A liquid dispersant or solvent present in the vehicle can be water with or without an amine such as ammonia. A variety of other vehicles known to the art can also be used, however, water based vehicles are preferred. A suitable water based dispersion can be an alkaline solution of an acidic resin. Upon drying, the resin may become water insoluble and form a film. Other film formers such as a polyvinyl acetate adhesive emulsion can be employed alone or with an acrylic resin. The pH of the vehicle can be controlled as required, e.g. with sodium hydroxide. The vehicle typically contains about 50% to 80% solids. The balance is water.

In one preferred form of the invention, there are uniformly suspended in the vehicle at least two kinds of dispersed particles. The first is the microwave interactive heat producing particle, e.g. carbon, optionally together with suspended metal particles such as aluminum, bronze or nickel particles in a minor amount of, say, about 1% to 20% by weight of the heat producing particles.

The electrically conductive carbon particles dispersed in the vehicle should be of a suitable carbon black such as channel black, furnace black, lamp black or other suitable source of carbon. The energy attenuator will affect various forms of carbon. While various suitable carbon blacks can be used, one suitable carbon black is 90 F. Black (Inmont Printing Inks Division of BASF Corporation, Chicago, Illinois, [I.P.I.]). Carbon black is typically present in an amount of about 1 to 5 times the amount of film forming resin solids basis.

Also dispersed in the vehicle, and preferably uniformly intermixed with the susceptor particles, are particles of an electrically non-conductive microwave non-interactive inorganic hydrated mineral attenuator adapted to release water of crystallization endothermically for dissipating or compensating in part for the heat produced by the microwave interactive particles. The attenuator is preferably used in an amount from about 2 to 20, and most preferably about 10 to 12, times the amount of carbon black or other susceptor (heater) present when used for popping popcorn. The attenuator is present in a sufficient amount to prevent localized overheating, sparking and burning. Various hydrated mineral attenuators can be employed in accordance with the invention to stabilize and control the heating characteristics of the microwave interactive susceptor particles. These hydrated mineral attenuator particles do not produce heat themselves. When heated in heat conductive relationship with the heat producing particles, they provide a cooling effect. The attenuator particles remain relatively inert until the dissociation temperature is reached. At this point water molecules are released to produce a cooling effect which stabilizes the temperature of the susceptor at the point reached when the water molecules begin to evolve until all of the water is driven off. In addition, each crystal may have sequential dissociation temperatures, i.e. $H_2O$ molecules begin to be liberated at temperatures much lower than the dissociation temperatures listed in Table 1. When used in the invention, the onset of cooling occurs at a much lower temperature. Table 1 temperatures are taken from The Handbook of Chemistry and Physics and indicate temperatures at which the crystals become completely anhydrous. At that time normal heating continues.

Examples of suitable hydrated mineral attenuator materials that can be employed in accordance with the invention are listed in the following table.

TABLE 1

| Mineral Attenuator | Formula | Complete Dissociation Temperature |
|---|---|---|
| Zinc 1 Phenol 4 Sulfonate Octahydrate | $Zn(C_6H_5SO_4)_2.8H_2O$ | 257° F. |
| Zirconium Chloride Octahydrate | $ZrOCl_2.8H_2O$ | 302° F. |
| Thorium Hypo Phosphate Hydrate | $ThP_2O_6.11H_2O$ | 320° F. |
| Magnesium Chlorplatinate Hexahydrate | $MgPtCl_6.6H_2O$ | 356° F. |
| Alumina Trihydrate | $Al_2O_3.3H_2O$ | 392° F. |
| Zinc Iodate Dihydrate | $Zn(IO_3)_2.2H_2O$ | 392° F. |
| Thallium Sulfate Heptahydrate | $Tl_2(SO_4)_3.7H_2O$ | 428° F. |
| Sodium Pyrophosphate Hydrate | $Na_2H_2P_2O_7.H_2O$ | 428° F. |
| Potassium Ruthenate Hydrate | $K_2RuO_6.H_2O$ | 392° F. |
| Manganese Chloride Tetrahydrate | $MnCl_2.4H_2O$ | 389° F. |
| Magnesium Iodate Tetrahydrate | $Mg(IO_3)_2.4H_2O$ | 410° F. |
| Magnesium Bromate Hexahydrate | $Mg(BrO_3)_2.6H_2O$ | 392° F. |
| Magnesium Antimonate Hydrate | $MgOSb_2O_5.12H_2O$ | 392° F. |
| Dysprosium Sulfate Octahydrate | $Dy_2(SO_4)_3.8H_2O$ | 392° F. |
| Cobalt Orthophosphate Octahydrate | $Co_3(PO_4)_2.8H_2O$ | 392° F. |
| Calcium Ditartrate Tetrahydrate | $CaC_4H_4O_6.4H_2O$ | 392° F. |
| Calcium Chromate Dihydrate | $CaCrO_4.2H_2O$ | 392° F. |
| Beryllium Oxalate Trihydrate | $BeC_2O_4.3H_2O$ | 428° F. |
| Sodium Thiosulfate Pentahydrate | $Na_2S_2O_3.5H_2O$ | 212° F. |
| Magnesium Sulfate Heptahydrate | $MgSO_4.7H_2O$ | 536° F. |
| Potassium Sodium Tartrate Tetrahydrate | KOCOCHOHCHOHCOONa. $4H_2O$ | 158° F. |
| Zinc Sulfate Heptahydrate | $ZnSO_4.7H_2O$ | — |

Both kinds of suspended particles are preferably dispersed in the vehicle conventionally until uniform dispersion is obtained as will be understood by those skilled in the printing art. Only enough of the attenuator needs to be provided to reduce the tendency for overheating to occur in the finished susceptor. If too much is present the heating effect will be reduced, but if too little is present, hot spots or burning may occur.

Minor amounts of known ink additives can be provided for improving flow and drying properties as well as the properties of the finished susceptor film. When an acrylic dispersion is used as a film former, an amine such as ammonia or an organic amine of any suitable known composition useful in printing inks can be employed to form a stable vehicle suspension. Sodium hydroxide can be used to control the pH.

The invention will be better understood by reference to the figures which illustrate the invention by way of example.

As shown in FIG. 1, a web 10 is unwound from supply roll 12, from left to right in the drawings. A fluid dispersion, for convenience referred to herein as "ink," present in supply pan 18 is picked up by a gravure roll 20 which is engraved with a repeating pattern 21 adapted to pick up the ink 19. Excess ink is removed by a doctor blade 22. The web passes over roll 13 and beneath a back-up roll 24 which presses the web against roll 20 to pick up the ink carried in the engraved areas 21 and thereby provide a spaced series of successive rectangular susceptor patches 26. The printed web 12 is dried, then passes over roll 25 and is later formed into containers, e.g. bags, trays, food support sheets, etc. It will be seen that the ink 19 carried in the pattern 21 has a rectangular shape in this case to provide a rectangular printed susceptor film 26. The film 26 is dried conventionally as by means of infrared and/or hot air dryers (not shown) or other suitable drying methods known to the art. When desired, another layer of flexible or non-flexible microwave transparent sheet material such as paper, paperboard or plastic (not shown) can be adhesively bonded over the ink layer 26 to enclose and encapsulate it between two sheets of microwave transparent material.

When spraying is used, the rolls 20–25 are replaced with a spraying nozzle (not shown) that is used to apply the dispersion to the backing web 10. In the alternative, when the web is dipped it is immersed in the fluid susceptor, withdrawn and then dried.

The susceptor coating 26 can comprise between about 1–20 weight percent of the conductive microwave interactive susceptor particles and about 0.5–5 weight percent of the film forming substrate or matrix. When carbon is used as the interactive material, it is preferred to use about 2–0 percent by weight of carbon black. The amount of the compensating attenuator material depends upon how much heat is produced, how effective the attenuator material is in cooling, how many bound water molecules are present, and the dissociation temperature.

When the susceptor 26 is to be used in a package for popping popcorn in a microwave oven, the printed susceptor patches 26 can be a solidly printed rectangle about 4 to 6 inches on a side at a weight of typically about 15–25 pounds per ream (432,000 square inches). The carbon content in the dried ink film is on the order of about 2% to 20%, and the attenuator content will be about 20% to 90% by weight of the dried film. The viscosity of the fluid ink and the characteristics of the printing roll controls the basis weight of the ink film applied to the paper sheet 10. More or less water or other solvent can be used to control the viscosity within a limited range. Better control of coating weight can be provided with the printing roll 20 by using a courser or finer pattern of half-tone dots engraved at 21. The formula of the dispersion 19, and primarily the amount of attenuator, is adjusted to regulate the cooling effect.

The amount of carbon or other heater present and the amount of the dispersion laid down control the amount of heat produced.

Halftone printing can be employed as a way of achieving a precise laydown of the dispersion. The desired basis weight of the patch 26 depends on the formula of the dispersion. For popping popcorn, the basis weight of the patch is typically about 15–25 lb per ream (432,000 square inches).

Figure 2:
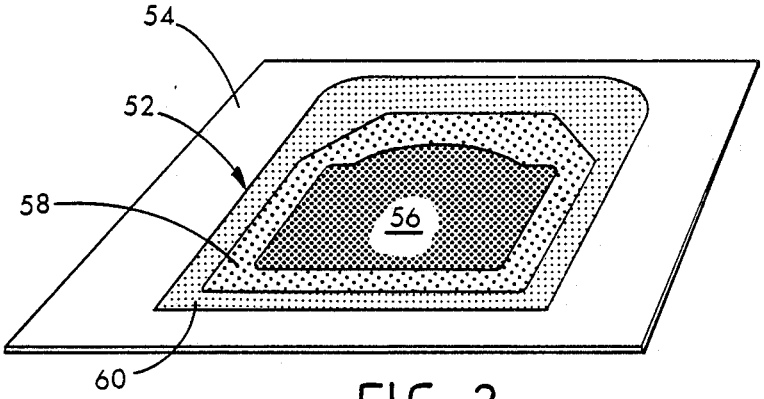
FIG. 2 is a perspective view of a susceptor in accordance with another form of the invention.

Refer now to FIG. 2 which illustrates another optional form of the invention. Shown in FIG. 2 is a backing sheet 54 which in this case is a 20-point food grade paperboard on which is printed a susceptor 52 having an outline shaped to conform generally to the outline of a food product to be placed against it. The susceptor 52 in this case comprises an area about 4¼ inches square. In the center is a solidly printed area 56 surrounded by a halftone printed area 58. This is surrounded by an area 60 which is approximately 50% open unprinted areas in the form of small unprinted circles or squares surrounded by grid lines. By using this form of the invention a greater amount of heat can be provided by the solidly printed center portion 56 precisely where the food is located while a reduced amount of heat is provided at 58 and 60 surrounding the food to supply additional heat but also assist in preventing runaway or excessive heating at the edges of the susceptor 52. The area 56 has 100% coverage, area 58 has 80% coverage, and area 60 has 50% coverage.

Figure 3:
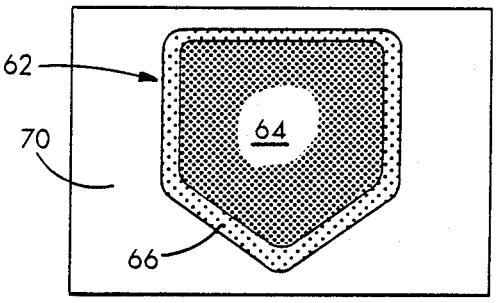
FIG. 3 is a plan view of a susceptor in accordance with another form of the invention.

Refer now to FIG. 3 which illustrates a further modified form of the invention which in this case comprises a greaseproof kraft paper backing 70 upon which is printed a chevron-shaped susceptor 62 having a solidly printed center section 64 surrounded by a printed grid portion 66 that is 80% printed and 20% open area. Using the susceptor 62, a greater amount of heat can be provided at the center with a reduced amount produced at the periphery by virtue of the reduction in the amount of susceptor material printed on the backing 70 at the edge. This reduces overheating, particularly at the edge of the patch 62. The embodiments described in FIGS. 2 and 3 provide an outer area or circular band in which the concentration of susceptor is low enough to keep the paper from igniting if this is a problem. It has been found that the burning or overheating is most likely to take place at the edge of the printed susceptor area. Reduced coverage in this zone reduces chance of damage or ignition of the susceptor backing sheet.

Figure 4:
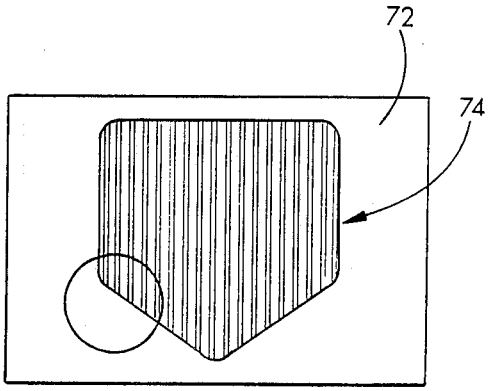
FIG. 4 is similar to FIG. 3 but having a different pattern.
Figure 5:
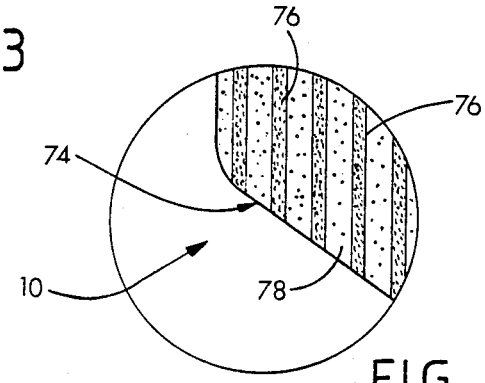
FIG. 5 is an enlarged view of a portion of FIG. 4.

Refer now to FIGS. 4 and 5 which illustrate still another form of the invention. In this case a paper sheet such as 50 pound greaseproof kraft paper sheet 72 is printed with a susceptor 74 having stripes 76 that are solidly i.e. 100% printed alternating with stripes that are 80% printed and 20% open. In this way, the amount of heat provided can be tailored to the precise amount of heat required so that the likelihood of uncontrolled heating is reduced.

The microwave interactive heat producing substance, i.e. susceptor material, will now be described in more detail. Various metals can be employed such as aluminum, copper, zinc, nickel, lead, stainless steel, iron, tin, chromium, manganese, silver, gold or their oxides. A variety of ferrites can be employed such as barium ferrite, zinc ferrite, magnesium ferrite, copper ferrite or other suitable ferromagnetic materials and alloys such as alloys of manganese, tin and copper or manganese, aluminum and copper, and carbides such as silicon carbide, iron carbide, strontium carbide and the like, as well as carbon. Of these, carbon is preferred because of its availability, cost and heating characteristics. The amount of microwave interactive susceptor such as carbon employed can be adjusted to obtain the desired rate of temperature rise to the dissociation point, say 392° F. The heat produced must be adjusted to fit the thermal requirements of the food item.

Adjustment of the hydrated attenuator present in the formula is accomplished by choosing one or a mixture of two or more of the appropriate dissociation temperature, as well as the number of water molecules bound in the compound It is believed that a greater number of water molecules present in the crystal structure of the attenuator will increase its cooling capacity. If two or more different hydrated attenuator particles are employed, it may be possible in some cases to obtain a stepped heating curve if required by particular heating conditions or to release water molecules progressively to lengthen the temperature range over which the cooling effect can be achieved.

If desired, the invention can also be applied to microwave susceptors of the type which employ a backing such as plastic film to which is applied a thin, semiconductive layer of metal usually by vacuum electrodeposition. The hydrated mineral attenuator particles can be incorporated as a layer above or below the metal coating or on the opposite side of the backing to keep the metallized sheet from overheating to the point where degradation is a problem.

The attenuator of the type described can also be applied as a separate layer adjacent to a layer of carbon or other heat producing susceptor and in heat conductive relationship with it to cool the susceptor during microwave heating.

In one preferred form of the invention a stable dispersion containing hydrated attenuator particles in accordance with the invention is laminated between a relatively gas and vapor impervious sheet and a relatively porous sheet such as kraft paper which forms the outside surface of a container such as a food container. Upon heating, the flow of water molecules from the susceptor coating will be toward the outside of the container because of the porosity of the kraft paper layer, thereby venting the water vapor and other gases into the atmosphere and preventing it from reaching the food.

The invention can be employed for heating, toasting, browning or crisping a variety of foods such as meat or fish patties, fish sticks, french fried potatoes, griddle foods including french toast, pancakes, waffles, pizza or for popping popcorn.

The invention will be better understood by reference to the following examples of various ink compositions employed in accordance with the invention. All quantities are expressed on a weight basis.

EXAMPLES

EXAMPLE 1

Attenuator is Alumina Trihydrate ($A1_2O_3.3H_2O$)

| component | weight (grams) | percent |
|---|---|---|
| $Al_2O_3.3H_2O$ | 58.00 | 47.56 |
| NaOH (.01N) | 23.50 | 19.27 |
| $H_2O$ | 15.44 | 12.66 |
| Polyvinyl Acetate Adhesive Emulsion* | 18.00 | 14.76 |
| Carbon Black | 5.05 | 4.14 |

-continued

| component | weight (grams) | percent |
|---|---|---|
| Acrylic Resin | 1.45 | 1.19 |
| Silicone Defoamer | .51 | .42 |
| | 121.95 | 100.00 |

*Duracet 12 by Franklin International, Inc. contains 44% moisture.

EXAMPLE 2

Attenuator is Alumina Trihydrate ($A1_2O_3.3H_2O$)

| component | weight (grams) | percent |
|---|---|---|
| $Al_2O_3.3H_2O$ | 67.00 | 46.90 |
| NaOH (.01N) | 24.00 | 16.80 |
| $H_2O$ | 30.15 | 21.10 |
| Carbon Black | 9.86 | 6.90 |
| Polyvinyl Acetate Adhesive Emulsion* | 9.00 | 6.30 |
| Acrylic Resin | 2.83 | 1.98 |
| Silicone Defoamer | .02 | .01 |
| | 142.86 | 99.99 |

EXAMPLE 3

Attenuator is Sodium Thiosulfate Pentahydrate ($Na_2S_2O_3.5H_2O$)

| component | weight (grams) | percent |
|---|---|---|
| $Na_2S_2O_3.5H_2O$ | 31.18 | 49.71 |
| $H_2O$ | 28.03 | 44.69 |
| Carbon Black | 2.72 | 4.34 |
| Acrylic Resin | .78 | 1.24 |
| Silicone Defoamer | .01 | .02 |
| | 62.72 | 100.00 |

EXAMPLE 4

Attenuator is Magnesium Sulfate Heptahydrate ($MgSO_47H_2O$)

| component | weight (grams) | percent |
|---|---|---|
| $MgSO_4.7H_2O$ | 64.85 | 58.06 |
| $H_2O$ | 39.56 | 35.42 |
| Carbon Black | 5.65 | 5.06 |
| Acrylic Resin | 1.62 | 1.45 |
| Silicone Defoamer | .01 | .01 |
| | 111.69 | 100.00 |

EXAMPLE 5

Attenuator is Zinc Sulfate Heptahydrate ($ZnSO_47H_2O$)

| component | weight (grams) | percent |
|---|---|---|
| $ZNSO_4.7H_2O$ | 84.40 | 62.54 |
| $H_2O$ | 41.07 | 30.43 |
| Carbon Black | 7.35 | 5.45 |
| Acrylic Resin | 2.11 | 1.56 |
| Silicone Defoamer | .02 | .01 |
| | 134.95 | 99.99 |

EXAMPLE 6

Attenuator is Potassium Sodium Tartrate Tetrahydrate ($KOCOCHOHCHOHCOONa.4H_2O$)

| component | weight (grams) | percent |
|---|---|---|
| $KOCOCHOHCHOHCOONa.4H_2O$ | 50.18 | 54.74 |
| $H_2O$ | 35.86 | 39.12 |
| Carbon Black | 4.37 | 4.77 |
| Acrylic Resin | 1.25 | 1.36 |
| Silicone Defoamer | .01 | .01 |
| | 91.67 | 100.00 |

EXAMPLE 7

Control; Carbon Black with no mineral attenuator

| component | weight (grams) | percent |
|---|---|---|
| $H_2O$ | 113.43 | 94.67 |
| Carbon Black | 4.96 | 4.14 |
| Acrylic Resin | 1.42 | 1.19 |
| Silicone Defoamer | .01 | .01 |
| | 119.82 | 100.00 |

EXAMPLE 8

Control; Alumina Trihydrate ($A1_2O_3.3H_2O$)

| component | weight (grams) | percent |
|---|---|---|
| $Al_2O_3.3H_2O$ | 5.93 | 62.62 |
| NaOH (.01N) | 3.54 | 37.38 |
| | 9.47 | 100.00 |

EXAMPLE 9

Control; Sodium Thiosulfate Pentahydrate ($Na_2S_2O_3.5H_2O$)

| component | weight (grams) | percent |
|---|---|---|
| $Na_2S_2O_3.5H_2O$ | 5.93 | 62.62 |
| $H_2O$ | 3.54 | 37.38 |
| | 9.47 | 100.00 |

EXAMPLE 10

Control; Magnesium Sulfate Heptahydrate ($MgSO_4.7H_2O$)

| component | weight (grams) | percent |
|---|---|---|
| $MgSO_4.7H_2O$ | 5.93 | 62.62 |
| $H_2O$ | 3.54 | 37.38 |
| | 9.47 | 100.00 |

EXAMPLE 11

Control; Zinc Sulfate Heptahydrate ($ZnSO_4.7H_2O$)

| component | weight (grams) | percent |
|---|---|---|
| $ZNSO_4.7H_2O$ | 5.93 | 62.62 |
| $H_2O$ | 3.54 | 37.38 |
| | 9.47 | 100.00 |

EXAMPLE 12

Control; Potassium Sodium Tartrate Tetrahydrate ($KOCOCHOHCHOHCOONa.4H_2O$)

| component | weight (grams) | percent |
|---|---|---|
| $KOCOCHOHCHOHCOONa.4H_2O$ | 5.93 | 62.62 |
| $H_2O$ | 3.54 | 37.38 |
| | 9.47 | 100.00 |

The following table presents the composition, basis weight and other characteristics of the dried film for Examples 1–7.

TABLE 2

| | Complete Description of Examples 1–7 | | | | | |
|---|---|---|---|---|---|---|
| Mineral Attenuator | Mineral Attenuator/ Carbon Black (weight ratio) | Total % Solids Content | Carbon Black (% of solids) | Sample Weight (grams) | Basis Weight ($gm/M^2$) | Carbon Black ($gm/M^2$) |
| Example 1: Alumina Trihydrate | 11.5 | 62.15 | 6.66 | 0.46 | 28.52 | 1.90 |
| Example 2: Alumina Trihydrate | 6.8 | 60.31 | 11.44 | 0.38 | 23.56 | 2.70 |
| Example 3: Sodium Thiosulfate Pentahydrate | 11.5 | 53.93 | 8.05 | 0.28 | 17.36 | 1.40 |
| Example 4: Magnesium Sulfate Heptahydrate | 11.5 | 42.53 | 11.90 | 0.27 | 16.74 | 1.99 |
| Example 5: Zinc Sulfate Heptahydrate | 11.5 | 44.41 | 12.27 | 0.29 | 17.98 | 2.21 |
| Example 6: Potassium Sodium Tartrate Tetrahydrate | 11.5 | 51.67 | 9.23 | 0.36 | 22.32 | 2.06 |
| Example 7: Carbon Black* | 0.0 | 5.23 | 79.16 | 0.04 | 2.48 | 1.96 |

*does not contain active mineral attenuator

Susceptor coatings are prepared and applied to a backing as follows.

After determining the target level of the microwave interactive component per unit area ($gm/M^2$) of the dried heater patch or strip, the formula of the liquid dispersion is calculated, then mixed and diluted with water to an appropriate consistency for laboratory draw downs. A sample of the dispersion is analyzed for "% solids".

A portion of the liquid dispersion is applied by drawing it down on 25 lb. greaseproof paper with an appropriate drawn down rod. The selection of one of the numbered draw down rods is based upon the desired basis weight of the dry susceptor film. Completed "draw downs" are hung vertically and allowed to air dry.

A comparison of the weights of the precisely cut pieces of plain paper and paper containing the dry susceptor film will yield basis weight of the film. Another quantity of the dried dispersion is analyzed for solids.

Samples are cut from the dried draw downs.

A special fixture was constructed from ⅜" sheets of G7 High Temperature Fiberglass. Two pieces of the sheet stock were cut into squares measuring 6¾" on each side. A central aperture (4¾" square) was machined into each square, yielding two identical frames. The test sample is held securely between the two frames, allowing unimpeded microwave exposure from both directions.

A Litton 1000 watt commercial microwave oven (Model: VEND-10) was used for these tests. Temperatures were derived by scanning infrared radiation given off by the sample during heating in the microwave oven. The results are shown in FIGS. 6–11.

A sample of the coated material prepared as in Examples 1–7 is placed between the two halves of the test fixture and the halves secured. The fixture containing the sample is placed in the oven cavity in an upright position. The sample fixture should be centered laterally, parallel to and 2½" back from the door, with the face of the sheet 10 containing the susceptor patch 26 facing the door. The door is then closed. The infrared instrument is focused if necessary, and a video cassette recorder is started.

A normal test sequence is 60 seconds at full power in a 1000 watt oven. However, testing is discontinued if the test sample is thermally consumed before the end of a normal test period.

The infrared temperature apparatus records a new set of complete temperatures every 33 milliseconds for the entire time. Any number of comparisons are possible with the accumulated data.

Hard copies of the screens are obtained by using 35 mm photography to capture the video display at 5 second intervals.

The results of the tests are shown in FIGS. 6–11.

Figure 6:
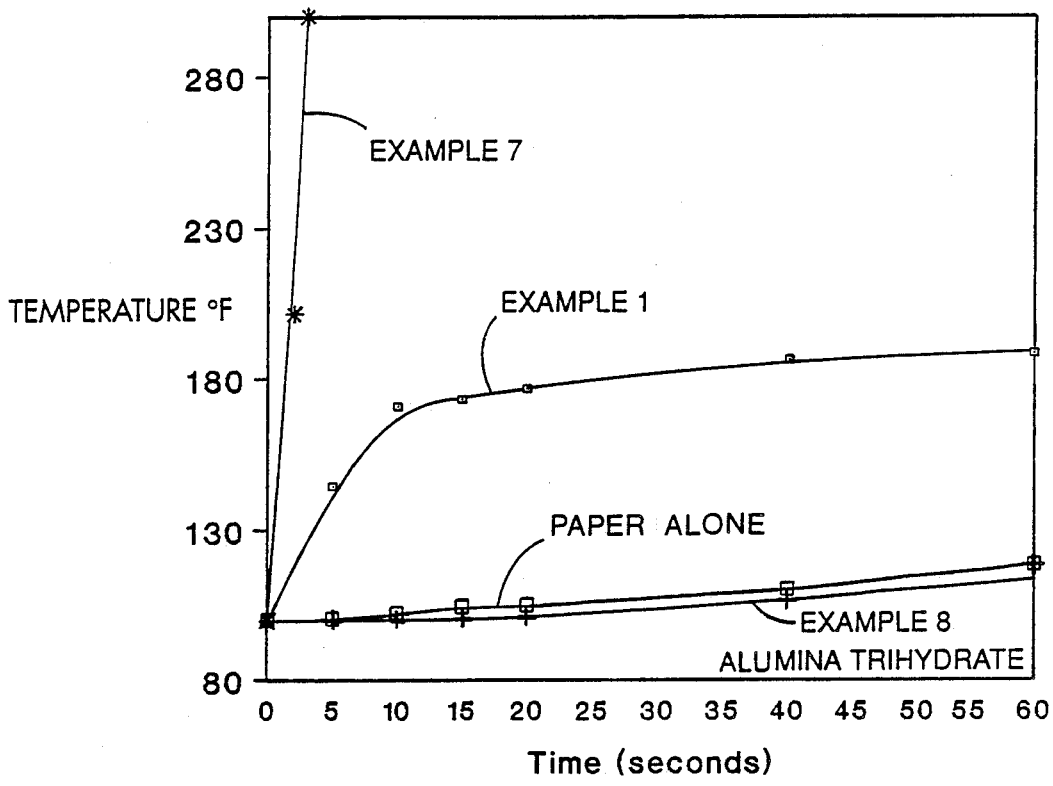
FIGS. 6–11 are graphs showing the heating characteristics of susceptors described in examples 1–7.

FIG. 6 In control Example 7, the specimen burst into flames after about 5–6 seconds. In Example 1, the temperature leveled off at about 180° F. and no combustion occurred. The carbon black sample data was suspended due to ignition of the substrate after six seconds. The two curves at the bottom of the graph are for comparative purposes to show the heating of paper alone and alumina trihydrate (Example 8).

Figure 7:
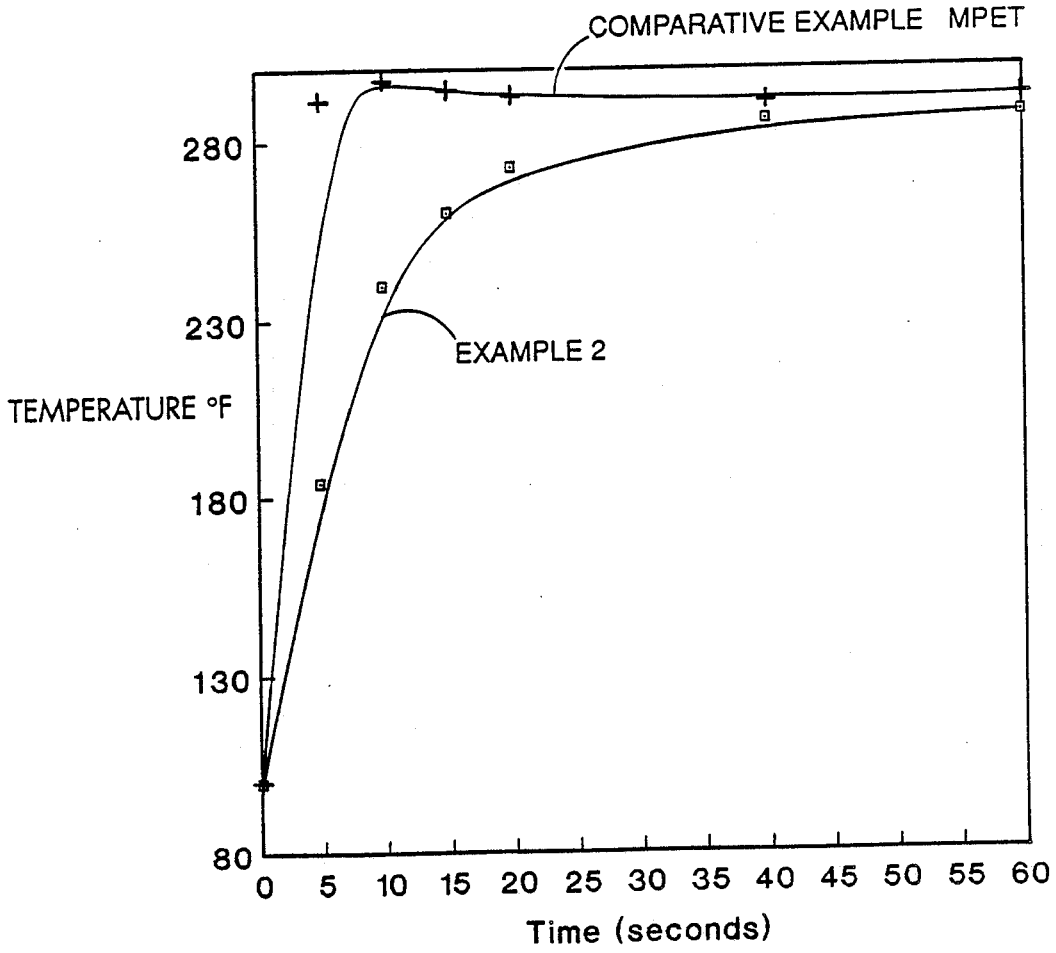

FIG. 7: In the sample marked MPET laminate (top curve), a specimen of semiconductive vacuum aluminized polyester film as described in U.S. Pat. No. 4,735,513 is used as an example of the prior art for comparative purposes. The lower curve resulted from the composition of the invention as described in Example 2. Heating approached 280° F. after about 5–15 seconds and leveled off.

Figure 8:
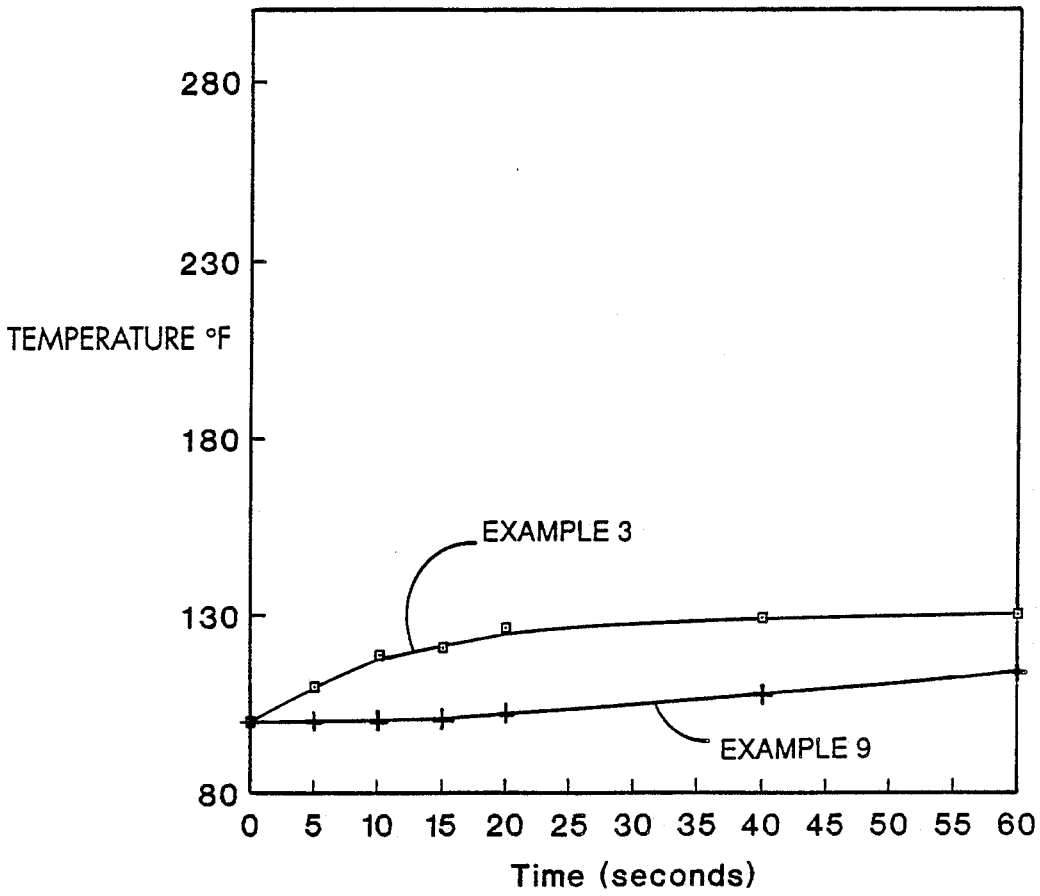

FIG. 8: The upper curve represents heating achieved with the composition of Example 3. The lower curve resulted from control Example 9 (no heat producing susceptor material present).

Figure 9:
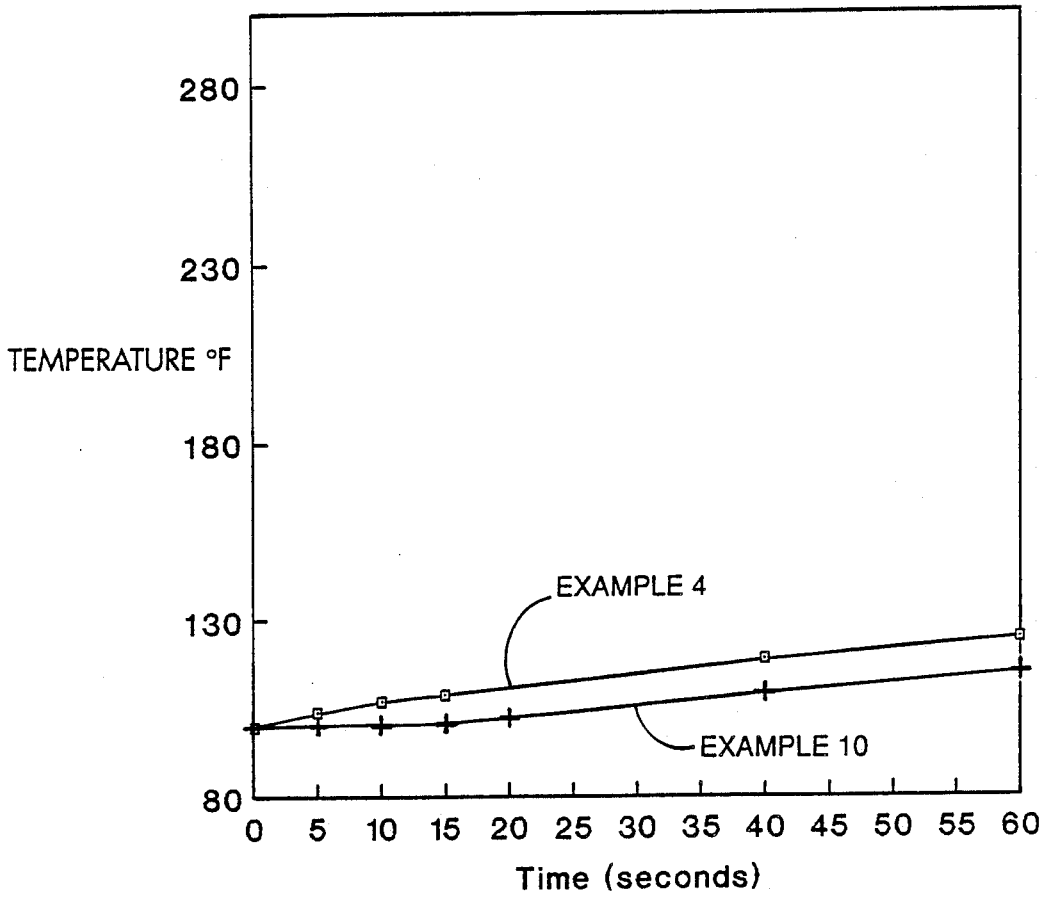

FIG. 9: The upper curve shows heating with the composition of Example 4 and the lower curve shows control Example 10.

Figure 10:
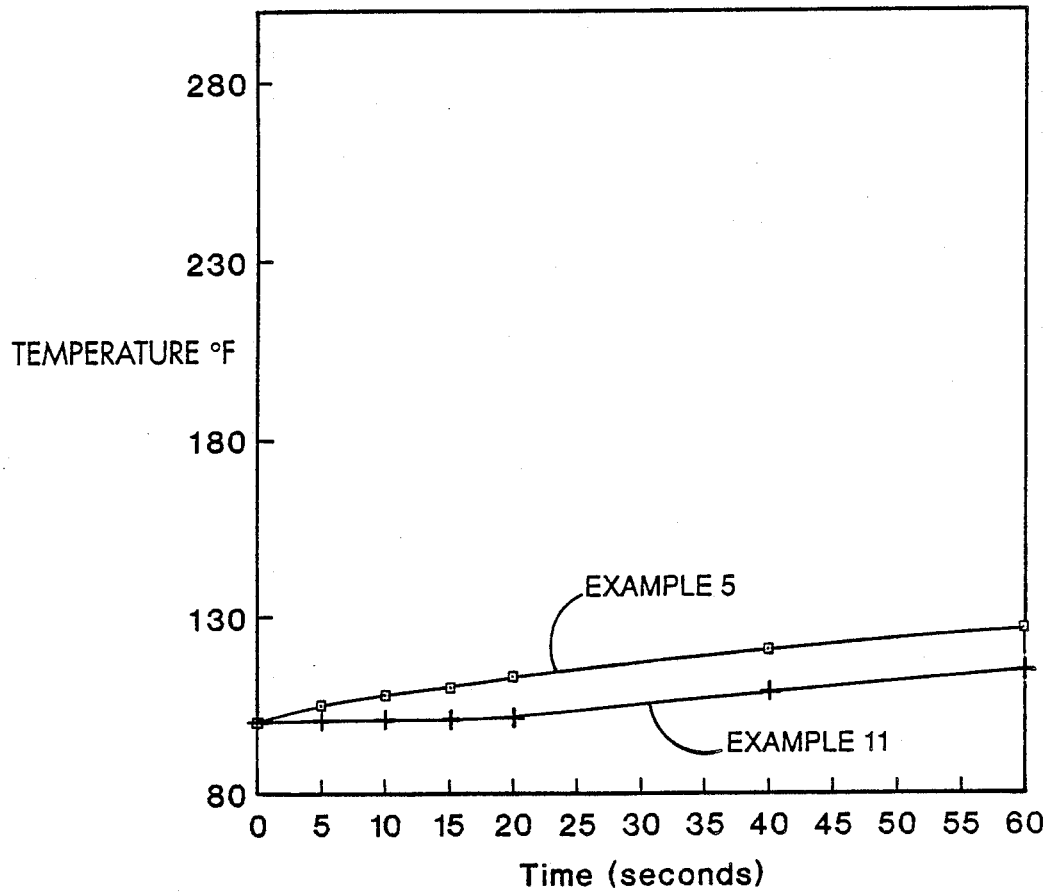

FIG. 10 shows the heating curves achieved from Example 5 and control Example 11, respectively.

Figure 11:
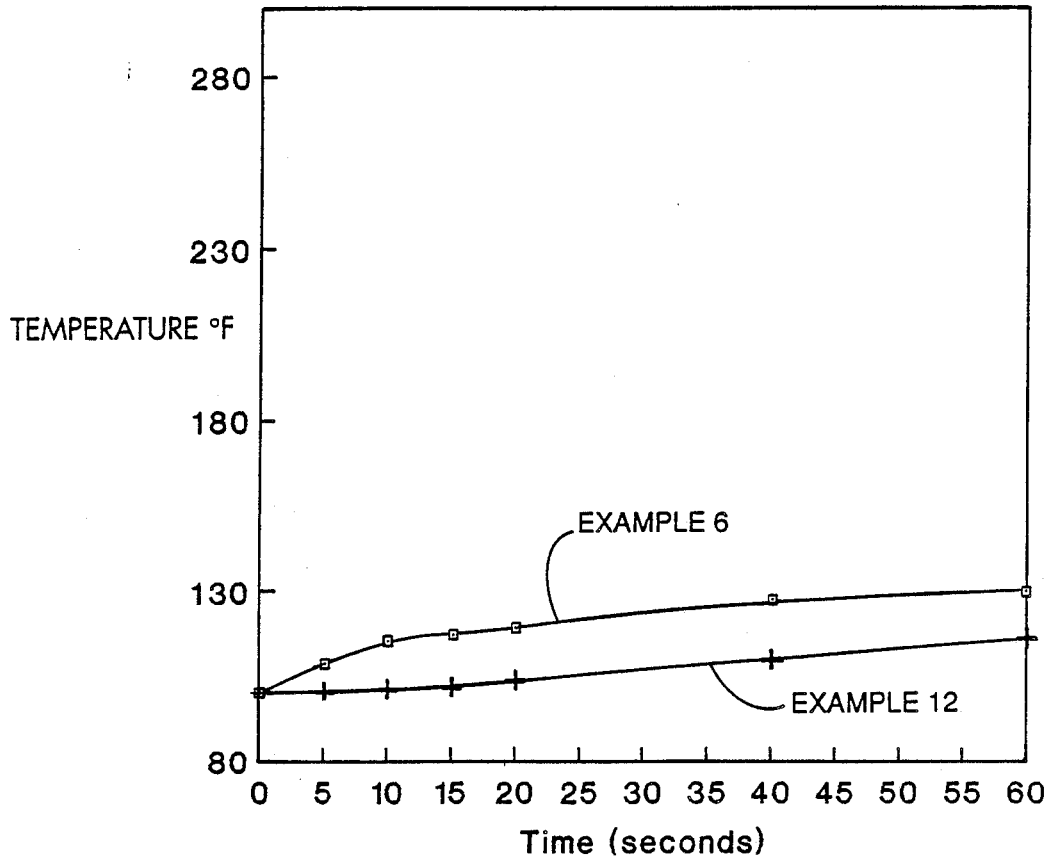

FIG. 11 shows the heating that resulted from Example 6 and control Example 12.

In each example, when hydrated mineral attenuator is used it had a cooling effect on the carbon contained in the composition. When the mineral attenuator was used without the microwave interative susceptor (carbon), almost no heat was produced. This shows that the hydrate itself produces no more heat than plain paper (FIG. 6).

Many variations of the present invention within the scope of the appended claims will be apparent to those skilled in the art once the principles described herein are understood.

We claim:

1. An article for microwave heating comprising, a microwave interactive heating susceptor that produces heat when exposed to microwave energy, a thermocompensating composition for preventing the overheating thereof, said thermocompensating composition comprising particles of an electrically nonconductive mineral hydrate attenuator containing bound water of crystallization and having a dissociation temperature at which the bound water is released therefrom between about 100° F. and 500° F., a binder for holding the particles together and said composition being in heat conductive relationship with said microwave interactive susceptor to control heat produced thereby when exposed to microwave energy.

2. The article of claim 1 wherein the thermocompensating composition is a coating applied to a backing comprising a microwave transparent sheet material.

3. The article of claim 1 wherein the microwave interactive susceptor is at least one member selected from the group consisting of carbon, metal and metal oxide.

4. The article of claim 1 wherein the binder comprises a film former composed of an organic resinous composition.

5. The article of claim 4 wherein the resinous binder comprises an acrylic resin.

6. The article of claim 4 wherein the film former comprises a polyvinyl acetate adhesive emulsion.

7. A thermocompensating susceptor bilayer comprising, a microwave transparent backing formed from an organic sheet that is stable during heating at least up to about 400° F. and a microwave susceptor layer thereon, said susceptor layer comprising a dried dispersion of finely divided particles composed of an organic film forming composition and at least two other kinds of particles in a liquid dispersant, one kind comprising microwave interactive particles adapted to absorb microwave energy and produce heat when exposed to microwave energy and the other particles comprising a thermocompensating mineral hydrate attenuator containing bound water of crystallization and having a dissociation temperature at which the bound water is released therefrom between about 100° F. and 500° F. to prevent overheating of the bilayer.

8. The bilayer of claim 7 wherein the mineral attenuator particles comprise a member selected from the group consisting of zinc 1 phenol 4 sulfonate octahydrate, zirconium chloride octahydrate, thorium hypophosphate hydrate, magnesium chlorplatinate hexahydrate, thorium selenate hydrate, aluminum oxide trihydrate, zinc iodate dihydrate, thallium sulfate heptahydrate, sodium pyrophosphate hydrate, potassium ruthenate hydrate, manganese chloride tetrahydrate, magnesium iodate tetrahydrate, magnesium bromate hexahydrate, magnesium antimonate hydrate, dysprosium sulfate octahydrate, cobalt orthophosphate octahydrate, calcium ditartrate tetrahydrate, calcium chromate dihydrate, beryllium oxalate trihydrate, magnesium sulfate heptahydrate, potassium sodium tartrate tetrahydrate and zinc sulfate heptahydrate.

9. The bilayer of claim 7 wherein the backing comprises paper or paperboard and the microwave interactive particles comprise a member selected from the group consisting of any of the following metals: nickel, zinc, tin, chromium, iron, gold, silver, magnesium, copper, manganese, aluminum, cobalt, barium and the oxides of such metals, carbon, graphite, barium titanite, barium ferrite, zinc ferrite, magnesium ferrite, copper ferrite, silicon carbide, iron carbide, strontium ferrite.

10. The bilayer of claim 7 wherein the mineral attenuator comprises at least two mineral attenuator substances having different water of crystallization dissociation temperatures for releasing bound water molecules at different temperatures when heated in a microwave oven.

11. The bilayer of claim 7 wherein the backing comprises paper or paperboard, the organic film forming resin comprises an acrylic resin, said liquid comprises water, and the interactive particles comprise aluminum oxide trihydrate.

12. The bilayer of claim 11 wherein the aluminum oxide trihydrate is present in the susceptor layer in the amount of between about 20% and 95% by weight of the susceptor layer.

13. The bilayer of claim 7 wherein different amounts of the susceptor are applied in different areas.

14. The bilayer of claim 13 wherein there are greater amounts of the susceptor applied in a center area and reduced amounts in a peripheral area of the bilayer to reduce, heating in a boundary area surrounding the center area of the susceptor.

15. A thermocompensating susceptor bilayer for microwave heating comprising, a microwave transparent backing formed from a sheet that is stable during heating at least up to about 400° F. and a microwave susceptor layer thereon, said susceptor layer comprising a dried dispersion applied as a liquid to the backing, the dried dispersion comprising a film forming composition and at least two kinds of particles in a liquid dispersant, one kind comprising microwave interactive particles adapted to absorb microwave energy and produce heat when exposed to microwave energy and the other particles comprising thermocompensating mineral attenuator particles that reduce the heating of the bilayer by producing a cooling effect when heated by the interactive particles to an elevated temperature to aid in stabilizing the temperature of the susceptor, the susceptor being applied non-uniformly to the backing with greater amounts of susceptor being applied in some areas than in others to thereby provide a bilayer having a relatively heavy coating of susceptor in one area and a lighter coating of susceptor in a second area to reduce arcing, scorching and burning of the susceptor bilayer in the area having the lighter coating.

16. The bilayer of claim 15 wherein greater amounts of the susceptor are applied in a central area and reduced amounts in a peripheral portion of the bilayer to reduce runaway heating or fringe heating in a boundary area surrounding the central area of the susceptor.

* * * * *

UNITED STATES PATENT AND TRADEMARK OFFICE

CERTIFICATE OF CORRECTION

PATENT NO. : 4,970,358

DATED : November 13, 1990

INVENTOR(S) : L. C. Brandberg, et al

It is certified that error appears in the above-identified patent and that said Letters Patent is hereby corrected as shown below:

Col. 14, line 26
change "interactive" to --attenuator--.

Signed and Sealed this

Fourteenth Day of July, 1992

*Attest:*

DOUGLAS B. COMER

*Attesting Officer*

*Acting Commissioner of Patents and Trademarks*